US006481042B1

(12) United States Patent
Hsieh

(10) Patent No.: US 6,481,042 B1
(45) Date of Patent: Nov. 19, 2002

(54) MOP HAVING CHANGEABLE STRUCTURE FOR CHANGING MOP MEMBER

(76) Inventor: Mei Nuan Hsieh, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 09/930,941

(22) Filed: Aug. 17, 2001

(51) Int. Cl.[7] ..... A47L 13/24

(52) U.S. Cl. ..... 15/229.2; 15/229.1; 15/228; 15/147.1

(58) Field of Search ..... 15/147.1, 229.1, 15/229.2, 229.6, 228

(56) References Cited

U.S. PATENT DOCUMENTS 1,611,442 A * 12/1926 Hillyard 3,328,822 A * 7/1967 Sellesi

* cited by examiner

*Primary Examiner*—Randall E. Chin

(57) ABSTRACT

A mop includes a bracket, a mop member engaged on the bracket. a frame engaged on the mop member and secured to the bracket for securing the mop member between the bracket and the frame. The frame includes a channel formed between two flanges for slidably and detachably receiving a bar. The bar includes a fastener detachably secured to a rod. A housing is engaged onto the bar and the frame for stably retaining the bar in the frame. The bar may be disengaged from the housing and the rod and the frame, and the frame may be removed from the bracket for changing the mop member.

5 Claims, 6 Drawing Sheets

MOP HAVING CHANGEABLE STRUCTURE FOR CHANGING MOP MEMBER

BACKGROUND OF THE INVENTION

1. Field of the Invention

The present invention relates to a mop, and more particularly to a mop including a changeable structure for allowing the mop members to be changed or replaced with the other ones.

2. Description of the Prior Art

Typical mops comprise a mop member, such as a spongy member or the like, solidly secured to the bottom end of a rod, for moping purposes. However, the mop member is solidly secured to the rod and may not be disengaged from the rod, such that the mop member may not be changed with the other ones. Particularly, the typical mop members are solidly secured to the wooden rod with a plastic bracket or the like. The wooden rod and the plastic bracket may be easily damaged or rotten after use. But, the mop members also may not be changed with the other ones after the wooden rod and the plastic bracket are damaged.

The present invention has arisen to mitigate and/or obviate the afore-described disadvantages of the conventional mops.

SUMMARY OF THE INVENTION

The primary objective of the present invention is to provide a mop including a changeable structure for allowing the mop members to be changed or replaced with the other ones.

In accordance with one aspect of the invention, there is provided a mop comprising a bracket, a mop member engaged on the bracket, a frame engaged on the mop member and secured to the bracket for securing the mop member between the bracket and the frame, the frame including a channel formed therein, a bar received in the channel of the frame and including a fastener extended therefrom, a housing engaged onto the bar and the frame for stably retaining the bar in the frame, and a rod including a first end secured to the fastener of the bar for securing the mop member to the rod. The bar may be disengaged from the housing and the rod, and the frame may be disengaged from the bracket, such that the mop member may be changed with the other ones after the mop member has been damaged.

The frame includes two ends, the bracket includes two ends each having a hook extended therefrom and engaged with the ends of the frame for securing the bracket to the frame, and for securing the mop member between the bracket and the frame.

The bracket includes two sides each having a fence extended therefrom for forming a recess between the fences.

The frame includes at least one aperture formed therein, the bracket includes at least one finger extended therefrom and engaged through the mop member and engaged through the aperture of the frame. The finger of the bracket may be bent to engage with the frame for further solidly securing the bracket to the frame, and for further securing the mop member between the bracket and the frame.

The frame includes two sides each having a flange extended therefrom for forming the channel thereof between the flanges.

The housing includes a chamber formed therein for receiving the frame and the bracket and for allowing the bar to be solidly and stably retained within the channel of the frame.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
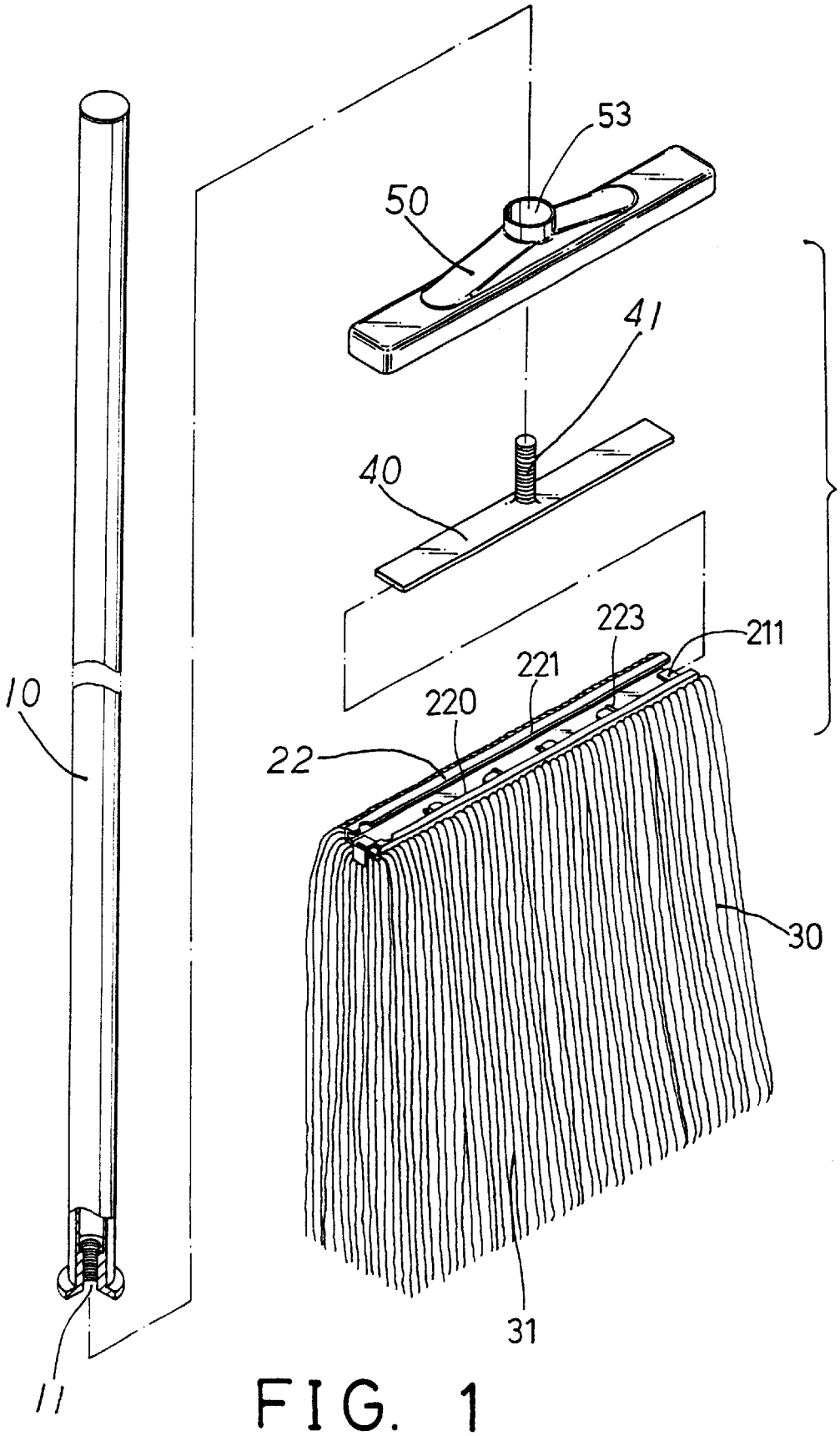
FIG. 1 is an exploded view of a mop in accordance with the present invention.
Figure 2:
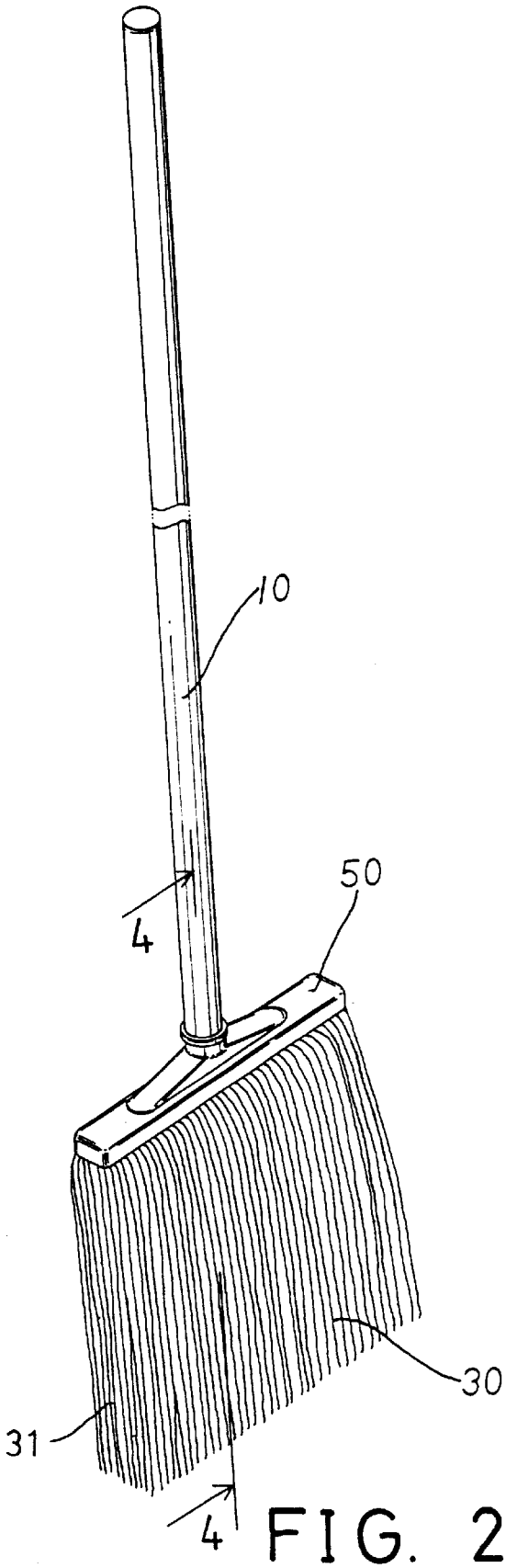
FIG. 2 is a perspective view of the mop.
Figure 4:
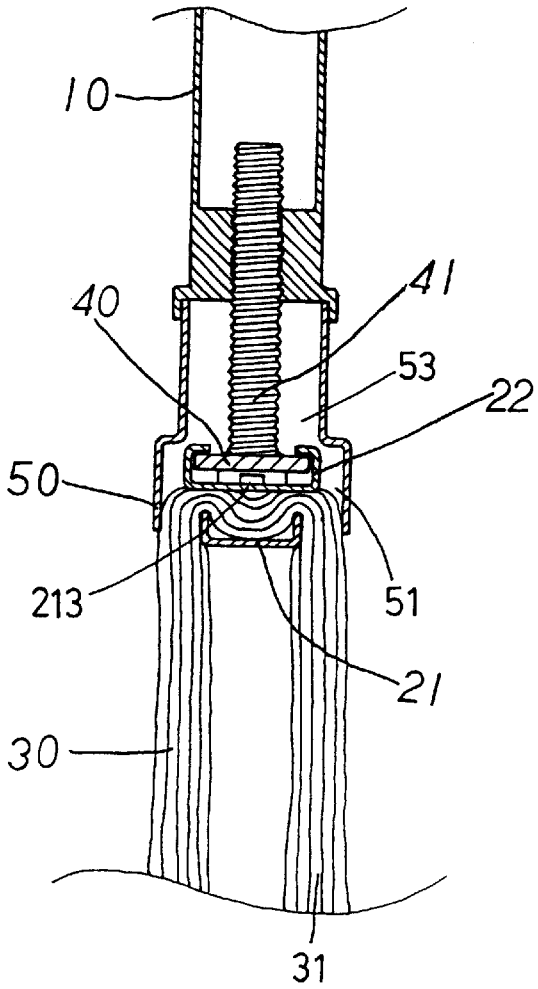
FIG. 4 is a partial cross sectional view taken along lines 4—4 of FIG. 2.
Figure 3:
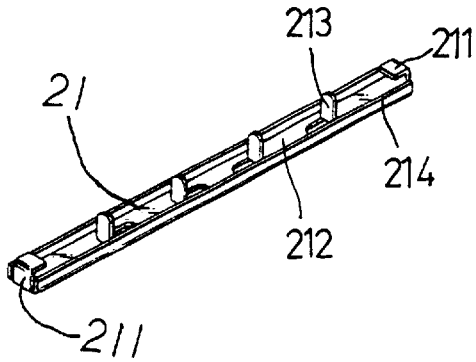
FIG. 3 is a perspective view of a bracket.

Referring to the drawings, and initially to FIGS. 1–4, a mop in accordance with the present invention comprises a bracket 21 including a substantially C-shaped cross section (FIG. 4) having a recess 212 formed therein and formed or defined by a pair of opposite fences 214. The bracket 21 includes two ends each having a hook 211 extended therefrom, and includes one or more fingers 213 extended outwardly through the recess 212 thereof and formed or provided between the fences 214 thereof. A mop member 30, such as a spongy member, or a cloth member, or a member includes a number of cloth threads or ropes or strings or cords 31 engaged over the bracket 21 and disposed between the hooks 211. The fingers 213 may be engaged into the cords 31 for stably or uniformly retaining the cords 31 on the bracket 21.

A frame 22 is engaged onto the cords 31 of the mop member 30 and onto the bracket 21, and includes a channel 220 formed therein and formed or defined by a pair of opposite flanges 221, and includes one or more apertures 223 formed therein for receiving the fingers 213 of the bracket 21. The hooks 211 of the bracket 21 may be engaged with the ends of the frame 22 for solidly and stably securing the mop member 30 between the bracket 21 and the frame 22. The fingers 213 may be bent to engage with the frame 22 for further solidly and stably securing the mop member 36 between the bracket 21 and the frame 22.

A bar 40 is detachably engaged and secured in the channel 220 of the frame 22, and includes a fastener, such as a bolt 41 extended therefrom, for threading to a screw hole 11 of a rod 10, and for detachably securing the bar 40 to the rod 10. A housing 50 includes a chamber 51 formed therein (FIG. 4) for receiving the frame 22 and/or the bracket 21, and for further solidly securing the mop member 30 between the bracket 21 and the frame 22, and for solidly retaining the bar 40 within the channel 220 of the frame 22. The housing 50 includes an orifice 53 formed therein for receiving the bolt 41 and for allowing the bolt 41 to be threaded with the screw hole 11 of the rod 10.

The bar 40 and the fastener 41 and the bracket 21 and the frame 22 are preferably made of metal materials, such as the stainless steel materials which will not be rotten or damaged after use. The frame 22 may be disengaged from the bar 40 and may be disengaged from the bracket 21 for allowing the mop member 30 to be changed with the other ones after the mop member 30 has been rotten or damaged.

Figure 5:
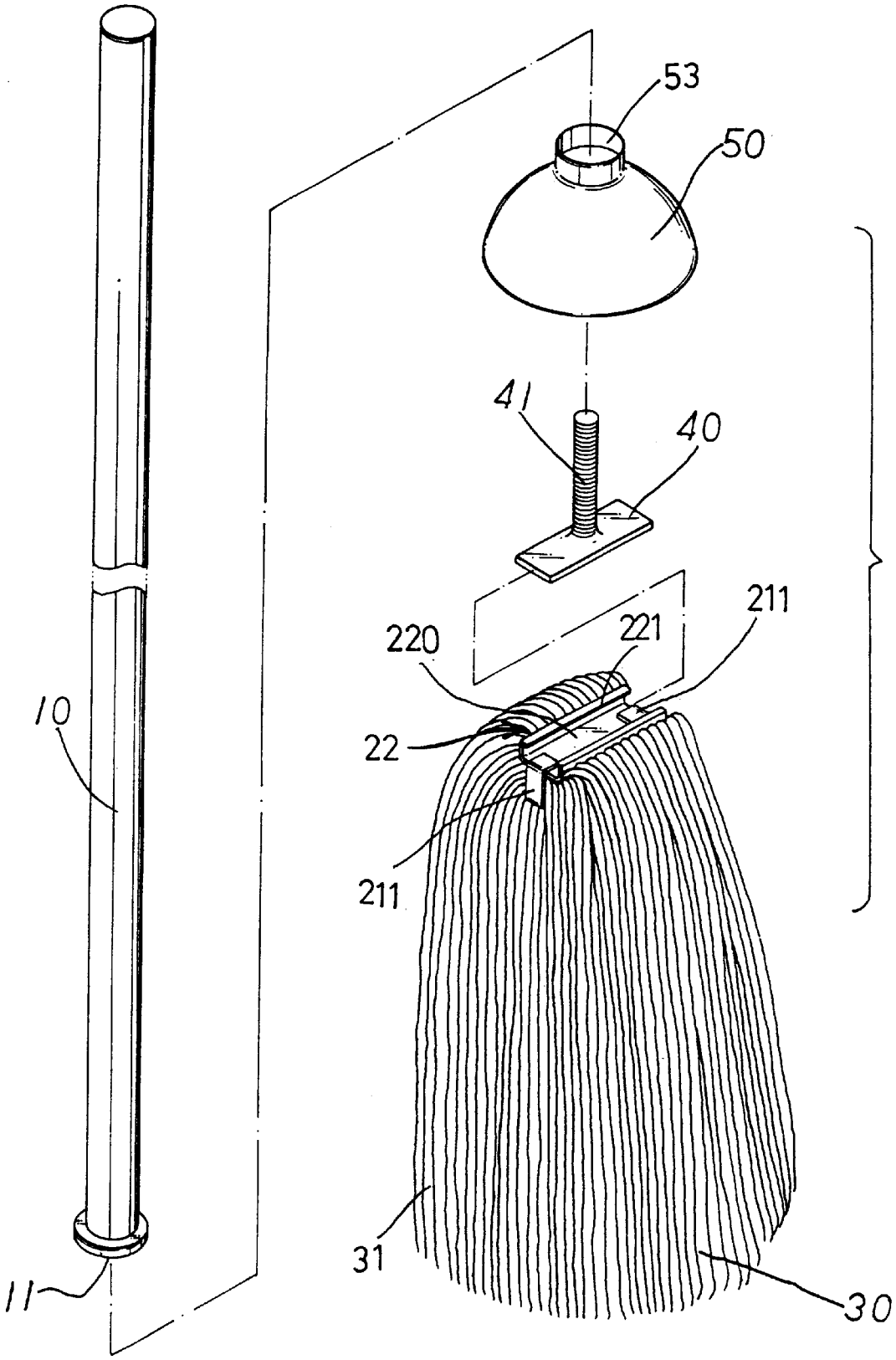
FIG. 5 is an exploded view similar to FIG. 1, illustrating the other arrangement of the mop.
Figure 6:
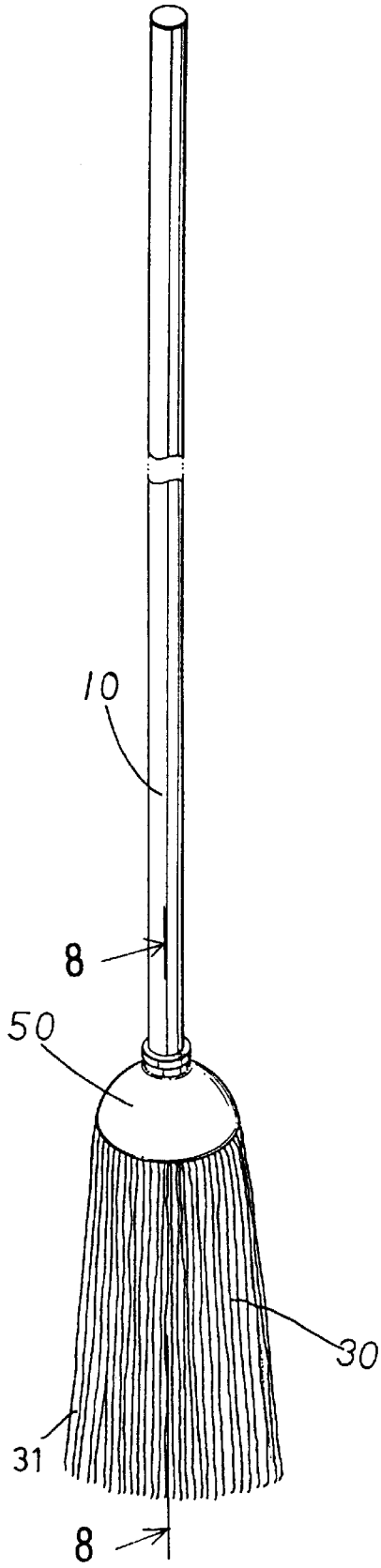
FIG. 6 is a perspective view of the mop as shown in FIG. 5.
Figure 7:
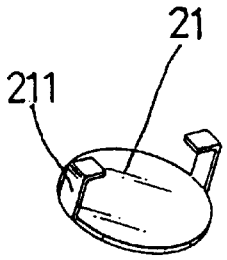
FIG. 7 is a perspective view of a bracket for the mop as shown in FIGS. 5 and 6.
Figure 8:
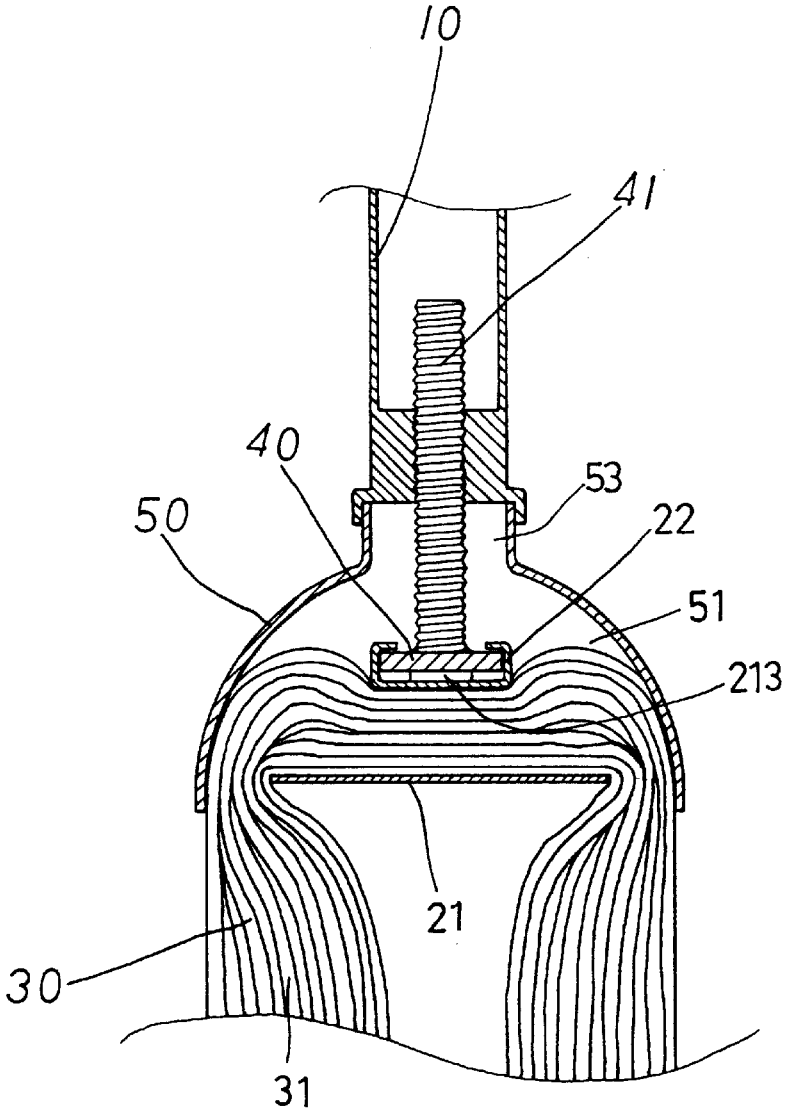
FIG. 8 is a partial cross sectional view taken along lines 8—8 of FIG. 6.

Referring next to FIGS. 5–8, the frame 22 and the bracket 21 may include a shorter configuration and the bracket 21 may include a circular shape for engaging into a housing 50 having such as a semi-spherical shape. The fastener 41 of the bar 40 may also be engaged through the orifice 53 of the housing 50.

Accordingly, the mop in accordance with the present invention includes a changeable structure for allowing the mop members to be changed or replaced with the other ones.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mop comprising:

a bracket, a mop member engaged on said bracket, a frame engaged on said mop member and secured to said bracket for securing said mop member between said bracket and said frame, said frame including a channel formed therein, a bar received in said channel of said frame and including a fastener extended therefrom, a housing engaged onto said bar and said frame for stably retaining said bar in said frame, said housing including a chamber formed therein for receiving said frame and said bracket, and a rod including a first end secured to said fastener of said bar for securing said mop member to said rod.

2. The mop according to claim 1, wherein said frame includes two ends, said bracket includes two ends each having a hook extended therefrom and engaged with said ends of said frame for securing said bracket to said frame, and for securing said mop member between said bracket and said frame.

3. The mop according to claim 1, wherein said bracket includes two sides each having a fence extended therefrom for forming a recess between said fences.

4. The mop according to claim 1, wherein said frame includes at least one aperture formed therein, said bracket includes at least one finger extended therefrom and engaged through said mop member and engaged through said at least one aperture of said frame.

5. The mop according to claim 1, wherein said frame includes two sides each having a flange extended therefrom for forming said channel between said flanges.

* * * * *